US005241717A

United States Patent [19]

Ward et al.

[11] Patent Number: 5,241,717

[45] Date of Patent: Sep. 7, 1993

[54] PROTECTIVE STRUCTURE AND BED FRAME WITH RIGID CANOPY

[76] Inventors: Jon P. Ward; Shirley J. Ward, both of 9001 White Fox La., Agua Dulce, Calif. 91350

[21] Appl. No.: 998,015

[22] Filed: Dec. 29, 1992

[51] Int. Cl.[5] ..... A47C 29/00; A47C 19/22

[52] U.S. Cl. ..... 5/201; 5/282.1; 5/285; 5/414; 5/420; 248/165

[58] Field of Search ..... 5/414, 200.1, 201, 2.1, 5/282.1, 285, 417, 420; 135/87, 106; 52/167; 248/165

[56] References Cited

U.S. PATENT DOCUMENTS

| | | | |
|---|---|---|---|
| 4,069,527 | 1/1978 | Harris | 5/414 |
| 4,490,864 | 1/1985 | Wicker, Jr. | 5/2.1 |
| 4,779,294 | 10/1988 | Miller | 5/414 |
| 4,782,541 | 11/1988 | Tuchman | 5/414 |
| 4,965,895 | 10/1990 | Shustov | 5/414 |
| 5,111,543 | 5/1992 | Epshetsky et al. | 5/414 |

FOREIGN PATENT DOCUMENTS

| | | | |
|---|---|---|---|
| 2569547 | 3/1986 | France | 5/414 |

OTHER PUBLICATIONS

"Pro Tech" Canopy-Trade Brochure from--Protech TM 7159 Navajo Road, San Diego, Calif. 92119.

*Primary Examiner*—Alexander Grosz
*Attorney, Agent, or Firm*—Denton L. Anderson

[57] ABSTRACT

The invention provides a protective structure which can be used to protect a localized area within home or work place. The invention is especially usable as a protective structure for a sleeping area or for a work table area. The invention includes a rectangular frame, vertical support members and a canopy. The structure is ideally made entirely out of steel or like material. The vertical support members include at each corner, a pair of linear members, such as tubular steel members. Each pair of linear members is in abutment at their upper ends but are spaced apart by several inches at their lower ends. Also, each pair of vertical members is tilted inwardly towards the center of the rectangular frame by about 7 degrees. By these techniques, the support structure is extremely rigid and is extremely resistant to lateral moments. The horizontal members which form the lower horizontal framework and the upper horizontal framework are easily detached and reattached so that the entire structure can be readily expanded or made smaller by simply changing out the several horizontal members for longer or shorter ones.

20 Claims, 4 Drawing Sheets

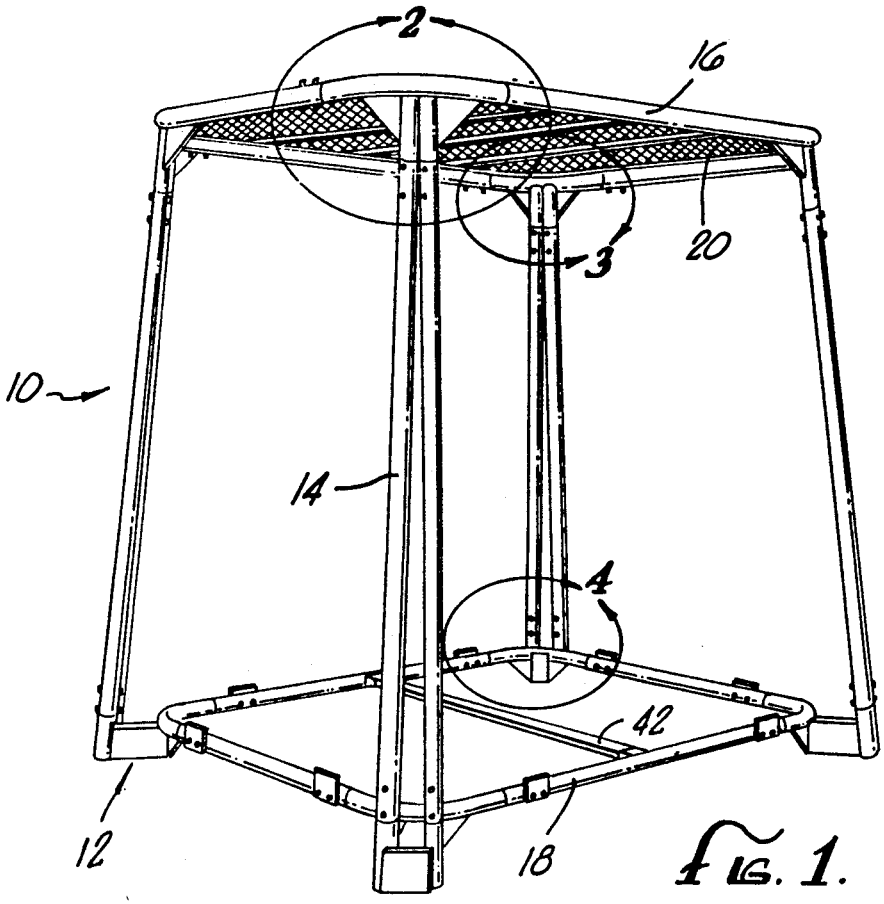
FIG. 1.
FIG. 2.
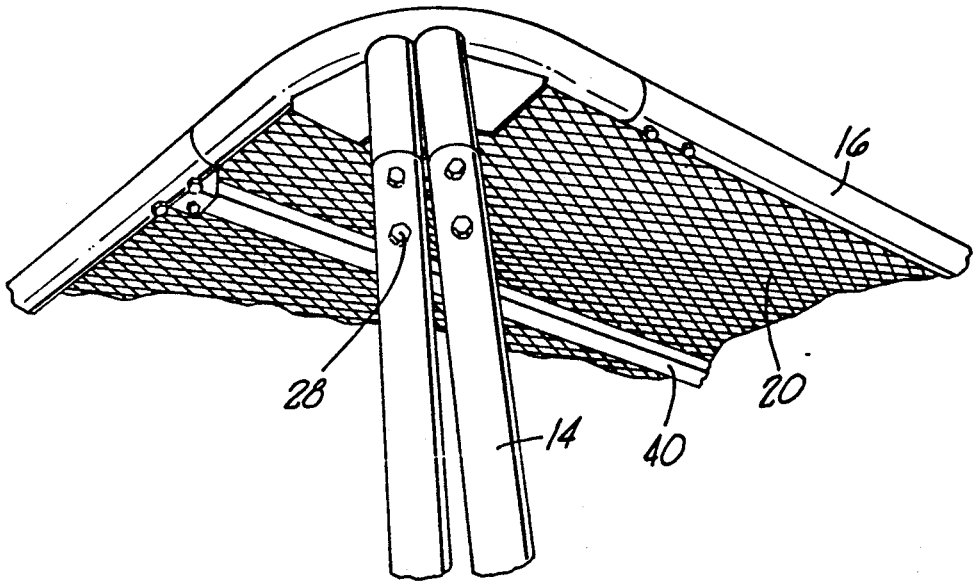

PROTECTIVE STRUCTURE AND BED FRAME WITH RIGID CANOPY

FIELD OF THE INVENTION

This invention relates generally to protective structures and specifically to protective structures suitable for earthquake protection of a localized area such as a sleeping area or a work area.

BACKGROUND OF THE INVENTION

Interest in structures which can protect people and property in collapsing buildings has markedly increased in the recent past. Much of this interest has been prompted by the need for increased earthquake preparedness, especially on the West Coast. As was seen in the recent earthquakes in Mexico City and San Francisco, an earthquake can cause the collapse of many man-made structures, even recently constructed structures. Without some sort of protective structure, lives and valuable property can be wiped out in an instant.

Several attempts have been made to construct protective structures, especially bed structures. Most of these structures, however, are strictly of a "box" type, wherein all of the corners are right angles. Such a box type protective structure is vulnerable to lateral moments.

Also, all of the previously known protective structures are of a fixed size, and cannot be easily expanded or made smaller to meet the changing needs of the user.

Accordingly, there is a need for a protective structure with increased strength over conventional box-type structures. There is a also a need for a protective structure which is easily expandable and contractible.

SUMMARY OF THE INVENTION

The invention satisfies these needs. The invention is a protective structure comprising: (a) a first, a second, a third and a fourth foot members disposed sequentially in a rectangular pattern and tangentially above a horizontal surface; (b) a first, a second, a third and a fourth pair of vertical members, each attached to a like-numbered foot member, and each vertical member having an upper end and a lower end; (c) a first, a second, a third and a fourth upper corner attachment member, each attached to the upper ends of a like-numbered pair of vertical members, and each having a left and a right attachment connector; (d) four lower horizontal members, each having a left end and a right end, the left end of each lower horizontal member being attached to a foot member and the right end being attached to an adjoining foot member; (e) four upper horizontal members, each having a left end and a right end, the left end of each upper horizontal member being attached to the right attachment connector of an upper corner attachment member and the right end being attached to the left attachment connector of an adjoining upper corner attachment member; and (f) a rigid canopy disposed between the upper horizontal members; wherein the lower ends of each pair of vertical members are spaced apart by a greater distance than at the upper ends; and wherein each vertical member is tilted inwardly by an angle of between about 5 and about 10 degrees from the vertical.

The canopy can be formed by cross-beams supporting an expanded metal.

In addition to the canopy, expanded metal, wire mesh or ballistics-nylon can be used to fill in the spaces between the vertical supports to form protective "walls."

Preferably, the horizontal members can be readily deattached and reattached to the corner members. This allows for the protective structure to be expanded or made smaller, depending upon the needs of the user.

The protective structure can be a bed frame by providing lower corner attachment members and connecting to adjoining lower corner attachment members a lower horizontal member to form a rectangular bed frame. A plurality of transverse support members can be disposed between the two longest horizontal members to form a base for a box spring and mattress.

The protective structure can also form protection for a desk or other work area by making at least one of the lower horizontal members contiguous to the floor.

The invention has been found to be a strong, yet light and easily assemblable structure which can provide a relative protection to users and their property in an earthquake or other catastrophic occurrence.

DESCRIPTION OF THE DRAWINGS

These and other features, aspects, and advantages of the present invention will become better understood with reference to the following description, appended claims, and accompanying drawings wherein:

FIG. 1 is a perspective view of a protective structure having featuresof the invention;

FIG. 2 is a detailed perspective of an upper corner of the structure shown in FIG. 1;

DESCRIPTION OF THE INVENTION

Figure 6:
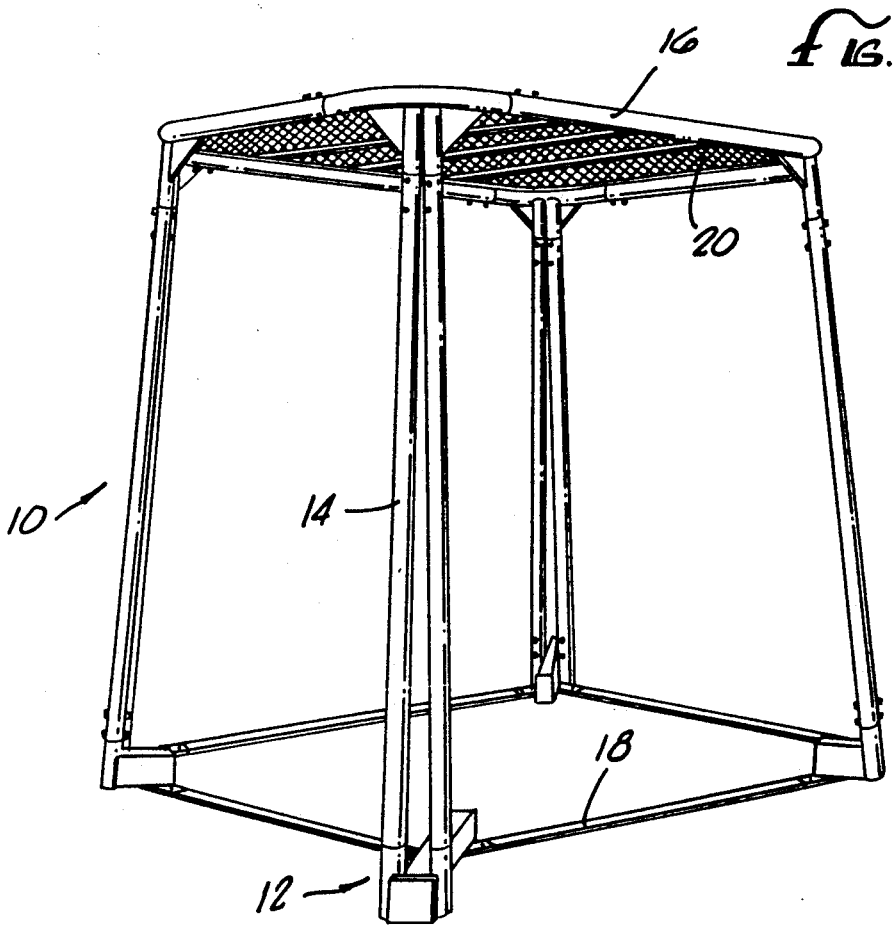
FIG. 6 is a perspective view of a second protective structure having features of the inventions.
Figure 9:
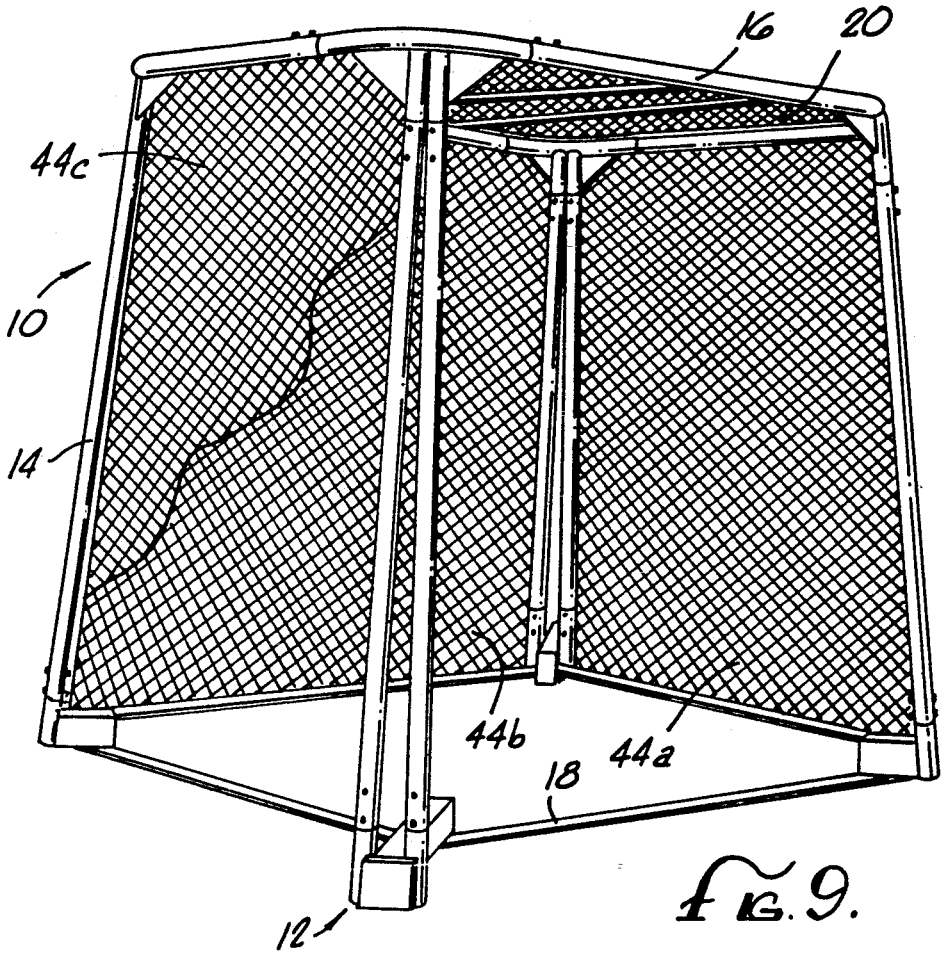
FIG. 9 is a perspective view of a third protective structure having features of the invention.
Figure 10:
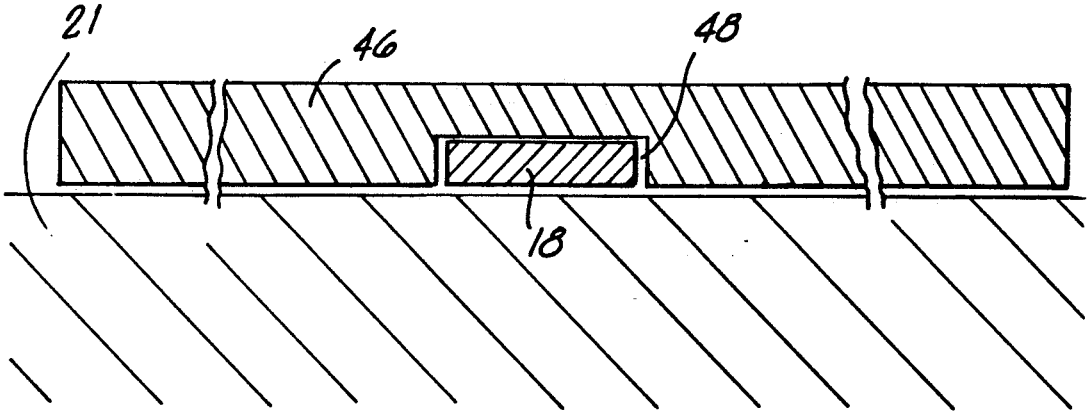
FIG. 10 is a side view of a floor member used with a horizontal rail of the structure shown in FIG. 6.

The invention is a protective structure 10 having foot members 12, vertical members 14, upper horizontal members 16, lower horizontal members 18 and a canopy 20. The protective structure 10 can be a bed frame as shown in FIG. 1 or it can be a general purpose furniture or personnel protective structure as shown in FIGS. 6 and 9.

The foot members 12 are disposed sequentially in a rectangular pattern tangential to a horizontal surface 21, such as a floor. As shown in the drawings, the foot members 12 can be constructed with a rectangular beam member 22, such as a box beam. Preferably, the rectangular beam member 22 is made of a steel.

Attached to the rectangular beam member 22 are two vertical member attachment members 24. Preferably, such vertical member attachment members 24 are steel and are rigidly attached to the rectangular beam member 22.

Attached to the vertical member attachment member 24 of each foot member 12 is a pair of vertical members 14. The vertical members 14 can be made of any strong and rigid material. Preferably, the vertical members 14 are made of tubular steel. The vertical members 14 are linear for maximum strength. In a typical embodiment, the vertical members 14 are two inch black iron pipe with a two and three eighths inch outside diameter.

In the embodiment shown in the drawings, the vertical members 14 are attached to the foot members 12 by male/female attachment joints 26. In the embodiments shown in FIGS. 3-5, the vertical members 14 are the female moieties of each male/female attachment joint 26 and the foot members 12 are the male moieties. Each of the male/female connection joints 26 are made rigid by bolts 28. Pins or the like can be used instead of the bolts.

The pair of vertical members 14 at each corner of the protective structure 10 are spaced apart at their lower ends by between about two and a half and about five inches, preferably between about three and about three and a half inches. The upper ends of each pair of vertical members 14, on the other hand, are in abutment or at least in close proximity to one another. This configuration gives each corner pair of vertical members 14 additional strength.

Also, each corner pair of vertical members 14 is tilted slightly towards the center of the rectangular pattern formed by the four foot members 12. Each pair of vertical members 14 is tilted inward by an angle of between about five and about ten degrees from the vertical, preferably between about six and about eight degrees from the vertical. Most preferably, the vertical members 14 are tilted inwardly between about seven and about seven and half degrees from the vertical. It is this inward tilt, coupled with the spacing at the base of each pair of vertical members 14, which gives the support structure of the invention superior protective strength over ordinary box-type structures. The inward tilt also allows each corner to be a supportive structure within itself.

Figures 3, 4, 5:
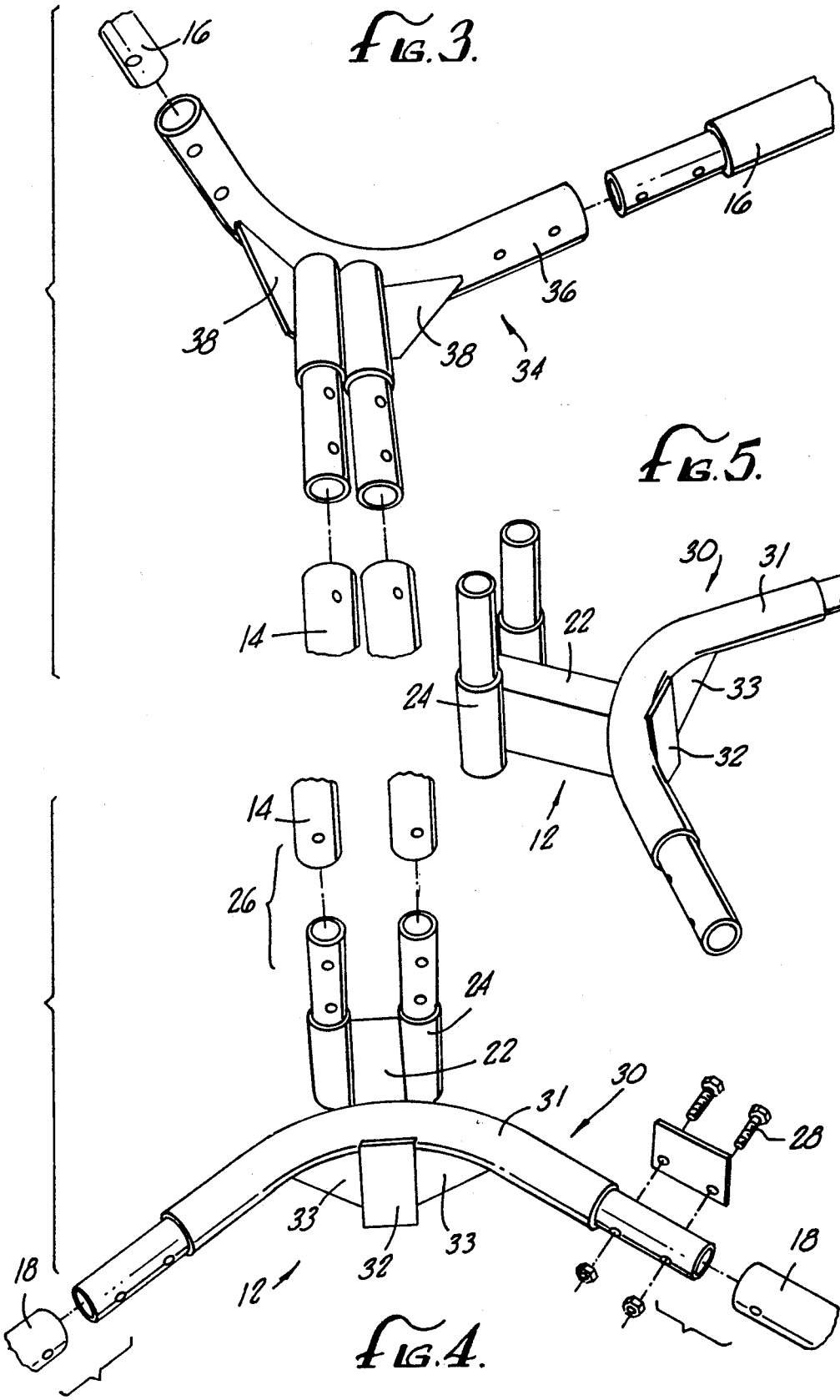
FIG. 3 is a second detailed perspective showing another upper corner of the structure shown in FIG. 1.
FIG. 4 is a detailed perspective of a lower corner of the structure shown in FIG. 1.
FIG. 5 is a second detailed perspective of a lower corner of the structure shown in FIG. 1.

Each foot member 12 is connected to another foot member 12 by a lower horizontal member 18. The lower horizontal members 18 can be elevated as shown in FIGS. 1, 4 and 5 or they can be contiguous with the horizontal surface 21, as shown in FIGS. 6 and 9. Lower horizontal members 18 which are contiguous with the horizontal surface 21 are desirable when the protected structure 10 is used to protect a desk, table, or other work surface. In such embodiments, it is important for the lower horizontal members 18 to be as flat and as close to the floor as possible. Therefore, lower horizontal members 18 contiguous with the horizontal surface 21 and made of a flat material such as a bar stock are preferred. A typical bar stock useable in the invention is a bar stock having a 2½ inch width and a ¼ inch thickness.

Preferably, the lower horizontal members 18 are made of a strong and rigid material, such as a steel. For bed frames, the lower horizontal members 18 can be made from a steel pipe, such as a two inch black iron pipe. Alternatively, the lower horizontal members can be made from bar stock.

Figure 7:
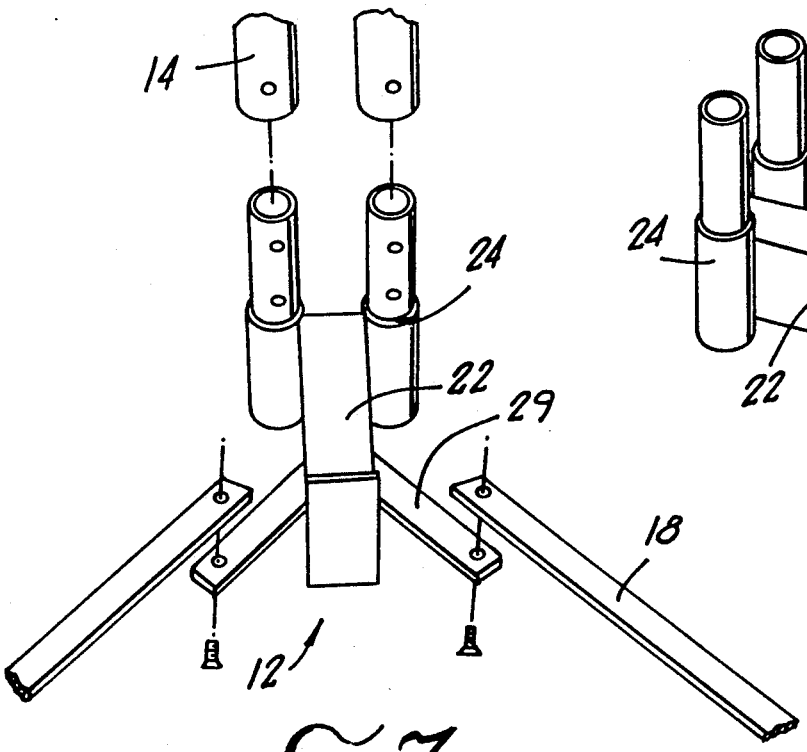
FIG. 7 is a detailed perspective view of a lower corner device useful in the protective structure shown in FIG. 6.
Figure 8:
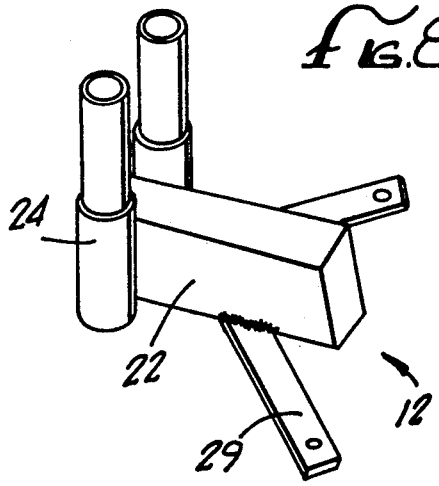
FIG. 8 is a second detailed view of a lower corner device useful in the protective structure shown in FIG. 6.

As shown in FIGS. 6 and 7, where the lower horizontal members 18 are made of a flat material which is disposed contiguous with a horizontal surface 21, the lower horizontal member 18 can be bolted to the foot member 12. In this embodiment, the foot member 12 comprises a pair of ears 29 made up of a flat rigid material, such as bar stock.

In embodiments wherein the structure forms a bed frame, such as shown in FIG. 1, the lower horizontal members 18 can be attached to the foot members 12 with lower corner attachment members 30 as shown in FIGS. 4 and 5. The lower corner attachment members 30 can be made from a section of tubular steel 31 with a 90° bend. Such lower corner attachment members 30 can be Welded to the rectangular member of the foot member 12 and reenforced with a front plate 32 and a pair of flanges 33, such as shown in FIGS. 4 and 5.

It is very important that the attachment point of the lower horizontal members 18 to each foot member 12 be spaced apart from the attachment point of the vertical members 14 to that foot member 12. Preferably, the distance between the attachment point of the lower horizontal member 18 and the foot member 12 is spaced apart from the attachment point of the vertical members 14 and the foot member 12 by between about 3 inches and about 10, more preferably, between about 4 inches and about 8 inches.

At the upper ends of each pair of vertical members 14 is an upper corner attachment member 34. In the embodiment shown in the drawings, particularly in FIG. 3, the upper corner attachment member 34 can comprise a pair of male/female attachment joints 26 affixed to a length of rolled steel 36 bent to a 90° angle. The length of rolled steel 36 is affixed to the upper ends of a pair of vertical members 14 by rigid means, such as by welding. In the embodiments shown in the drawing, the rigidity is reenforced by a pair of flange members 38.

All of the joints in the protective structure 10 are preferably readily disconnectible and reconnectible, such as male/female connection joints. The joints are held together firmly by bolts 28, pins or the like. For quick assembly military applications, "pip" pins can be used. This configuration allows the structure to be readily expanded or compressed by merely replacing the horizontal members 16 and 18 with ones which are longer or shorter.

The canopy 20 is made of a rigid material. In a typical embodiment, such as those shown in the drawings, the canopy 20 is made of an expanded metal, reenforced by horizontal upper cross-members 40.

Where the protective structure 10 is to be used as a bed frame, the structure further comprises a plurality of transverse support members 42 disposed between the two longest lower horizontal members 18.

In a specialized embodiment shown in FIG. 9, the protective structure 10 can be useful in military and other hazardous environments. In this embodiment, the protective structure 10 further comprises walls 44 of expanded metal, wire mesh or ballistics-nylon to further protect people and equipment within the structure. The embodiment shown in FIG. 9 has three such walls, a right wall 44*a*, a rear wall 44*b*, and a left wall 44*c* (shown partially cut away).

Where the protective structure 10 is to be used to protect a desk or a table or some other work surface, it is generally preferable for the protective structure 10 to further comprise a floor mat 46 which can be laid across one of the lower horizontal members 18. Preferably, the floor mat 46 has a groove 48 on its underside which is dimensioned to accept the lower horizontal member 18 and can otherwise lie flat on the horizontal surface 21.

In this embodiment, a user can push a chair back and forth across the floor mat 46 without the irritation of bumping into the lower horizontal member 18.

The foregoing describes in detail several preferred embodiments of the invention. The foregoing should not be construed, however, as limiting the invention to the particular embodiments describes. Practitioners skilled in the art will recognize numerous other embodiments as well. For a definition of the complete scope of the invention, the reader is directed to the appended claims.

What is claimed is:

1. A protective structure adapted to provide a protected area of a sufficient size to accommodate at least one human user, said protective structure being of sufficient strength and rigidity to protect a user from falling debris or the like, comprising:

(a) a first, a second, a third and a fourth foot members disposed sequentially in a rectangular pattern and tangentially above a horizontal surface;

(b) a first, a second, a third and a fourth pair of vertical members, each attached to a like-numbered foot member, and each vertical member having an upper end and a lower end;

(c) a first, a second, a third and a fourth upper corner attachment member, each attached to the upper ends of a like-numbered pair of vertical members, and each having a left and a right attachment connector;

(d) four lower horizontal members, each having a left end and a right end, the left end of each lower horizontal member being attached to a foot member and the right end being attached to an adjoining foot member;

(e) four upper horizontal members, each having a left end and a right end, the left end of each upper horizontal member being attached to the right attachment connector of an upper corner attachment member and the right end being attached to the left attachment connector of an adjoining upper corner attachment member; and (f) a rigid canopy disposed between the upper horizontal members;

wherein the lower ends of each pair of vertical members are spaced apart by a greater distance than at the upper ends; and wherein each vertical member is tilted inwardly by an angle of between about 5 and about 10 degrees from the vertical.

2. The protective structure of claim 1 wherein at least one of the horizontal members is contiguous with the horizontal surface.

3. The protective structure of claim 1 wherein the foot members, the vertical members, the lower corner attachment members, the upper corner attachment members, the horizontal members, and the canopy are made of a steel.

4. The protective structure of claim 1 wherein the lower ends of each pair of vertical members are spaced apart by between about 2½ and about 5 inches.

5. The protective structure of claim 1 wherein each end of the horizontal members is spaced apart from the adjoining ends of pairs of vertical members by between about 3 and about 3½ inches.

6. The protective structure of claim 2 wherein the height of the horizontal member which is contiguous with the horizontal surface is less than about ¾ inches high and wherein the protective structure further comprises a floor mat having an upper side with a flat surface and a lower side with a groove, the groove being dimensioned to receive the horizontal member which is contiguous with the horizontal surface, so that the floor mat fits over that horizontal member and otherwise lies flat upon the horizontal surface.

7. A bed frame of sufficient rigidity to provide protection from falling debris or the like, comprising:

(a) a first, a second, a third and a fourth four foot members disposed sequentially in a rectangular pattern;

(b) a first, a second, a third and a fourth pair of vertical members, each attached to a like-numbered foot member, and each vertical member having an upper end and a lower end;

(c) a first, a second, a third and a fourth lower corner attachment members, each attached to the lower ends of a like-numbered foot member, and each having a left and a right attachment connector;

(d) a first, a second, a third and a fourth upper corner attachment member, each attached to the upper ends of a like-numbered pair of vertical members, and each having a left and a right attachment connector;

(e) four lower horizontal members, each having a left end and a right end, the left end of each lower horizontal member being attached to the right attachment connector of a lower corner attachment member and the right end being attached to the left attachment connector of an adjoining lower corner attachment member;

(f) four upper horizontal members, each having a left end and a right end, the left end of each upper horizontal member being attached to the right attachment connector of an upper corner attachment member and the right end being attached to the left attachment connector of an adjoining upper corner attachment member; and (g) a rigid canopy disposed between the upper horizontal members;

wherein the lower ends of each pair of vertical members are spaced apart by a greater distance than at the upper ends; and wherein each vertical member is tilted inwardly by an angle of between about 5 and about 10 degrees from the vertical.

8. The bed frame of claim 7 wherein the foot members, the vertical members, the lower corner attachment members, the upper corner attachment members, the lower horizontal members, the upper horizontal members, and the canopy are made of a steel.

9. The bed frame of claim 7 wherein the vertical members and the horizontal members are made of a tubular steel.

10. The bed frame of claim wherein the lower ends of each pair of vertical members are spaced apart by between about 2½ and about 5 inches.

11. The bed frame of claim 7 wherein the lower ends of each pair of vertical members are spaced apart by between about 3 and about 3½ inches.

12. The bed frame of claim 7 wherein each vertical member is tilted inwardly by an angle of between about 7 and about 7½ degrees from the vertical.

13. The bed frame of claim 7 wherein each lower corner attachment member is spaced apart from the lower ends of like-numbered pairs of vertical members by between about 3 and about 10 inches.

14. The bed frame of claim 7 wherein the lower corner attachment members are between about 4 and about 8 inches above a horizontal surface upon which the bed frame is placed.

15. The bed frame of claim 7 wherein each vertical member is attached to a foot and to an upper corner attachment member by male/female attachment joints.

16. The bed frame of claim 7 wherein each horizontal member is attached to a corner attachment member by a male/female attachment joint.

17. The bed frame of claim 15 wherein each male/-female attachment joint is bolted together.

18. The bed frame of claim 16 wherein each male/-female attachment joint is bolted together.

19. The bed frame of claim 7 further comprising a plurality of transverse support members disposed between two parallel horizontal members.

20. The bed frame of claim 7 wherein the canopy is made of an expanded metal.

* * * * *